US006299024B1

(12) United States Patent
Corba

(10) Patent No.: US 6,299,024 B1
(45) Date of Patent: Oct. 9, 2001

(54) VALVE ASSEMBLY FOR DISPENSING CONTAINER

(76) Inventor: Robert E. Corba, 4636 Stonebridge Dr., Racine, WI (US) 53404

( * ) Notice: Subject to any disclaimer, the term of this patent is extended or adjusted under 35 U.S.C. 154(b) by 0 days.

(21) Appl. No.: 09/609,779

(22) Filed: Jul. 5, 2000

(51) Int. Cl.[7] ..... B67D 5/60

(52) U.S. Cl. ..... 222/145.5; 222/136; 222/402.1; 222/518

(58) Field of Search ..... 222/136, 135, 222/389, 387, 402.1, 145.5, 145.1, 402.18, 514, 518

(56) References Cited

U.S. PATENT DOCUMENTS 3,592,359 * 7/1971 Marraffino ..... 222/94

* cited by examiner

*Primary Examiner*—Kevin Shaver
*Assistant Examiner*—Patrick Buechner
(74) *Attorney, Agent, or Firm*—Jansson, Shupe & Munger, Ltd.

(57) ABSTRACT

A mixing valve assembly is provided for a container structure. The mixing valve assembly includes a valve stem having an inlet within the container structure and an outlet external of the container structure. The valve stem is movable between a first depressed position wherein the composition is retained in the container structure and a second position wherein the composition exits the container structure through the outlet of the valve stem. A generally concave biasing structure extends from the valve stem and urges the valve stem toward the first position.

12 Claims, 4 Drawing Sheets

VALVE ASSEMBLY FOR DISPENSING CONTAINER

FIELD OF THE INVENTION

This invention relates generally to containers, and in particular, to a valve assembly for a dispensing container which facilitates the mixing of a plurality of compositions during discharge thereof from the dispensing container.

BACKGROUND AND SUMMARY OF THE INVENTION

It is known to provide a dispensing container which allows for the dispensing of more than one flowable substances contained therein through a single nozzle. Typically, these types of dispensing containers include separate compartments for receiving corresponding compositions prior to use. The nozzle releases the compositions from their compartments and from the dispensing container. A chamber is provided in the nozzle for mixing the composition just prior to flowing from the nozzle since many compositions cannot be mixed until use.

In view of the foregoing, dispensing containers must be capable of mixing the compositions stored therein in proper proportions and only in those amounts required for use at one time. In order to insure that properly metered amounts of compositions are mixed, various types of mixing valve assemblies have been developed. However, such prior art mixing valve assemblies are often times constructed using numerous parts making assembly difficult and time consuming. In addition, by utilizing a great number of parts, such prior art mixing valve assemblies are expensive to manufacture and may be more prone to failure.

Therefore, it is a primary object and feature of the present invention to provide a mixing valve assembly for a dispensing container which is simple and inexpensive to manufacture.

It is a further object and feature of the present invention to provide a mixing valve assembly for a dispensing container which properly meters a plurality of compositions stored in the dispensing container during dispensing of the compositions therefrom.

It is a still further object and feature of the present invention to provide a mixing valve assembly for a dispensing container which incorporates a minimum number of parts and which are less prone to failure than prior art devices.

In accordance with the present invention, a mixing valve assembly is provided for a container structure. The container structure has a first chamber for storing a primary composition, a second chamber for storing a secondary composition, and a dispensing member for urging the primary composition from the first chamber and the secondary composition from the second chamber. The mixing valve assembly includes a valve housing extending along a longitudinal axis and defining a first flow chamber. The valve housing includes a first opening in communication with the first chamber, and a second opening in communication with the second chamber, and a third opening communicating with the environment external to the container structure. A first seal is disposed in the second opening in the valve housing for isolating the second chamber from the flow chamber. A second seal is disposed in the third opening in the valve housing for isolating the flow chamber from the environment external of the container structure. A valve stem extends along a longitudinal axis through the first and second seals and has a central passageway therethrough. The valve stem has an inlet, an outlet external of the container structure, and a mixing opening therebetween. The valve stem is movable between a first position wherein the inlet is closed by the first seal and wherein the mixing opening is closed by the second seal and a second depressed position wherein the inlet is in communication with the second chamber and the mixing opening is in communication with the flow chamber. A generally concave biasing structure extends from the valve stem and urges the valve stem into the first position.

A sealing structure extends radially from the valve stem at a location adjacent the mixing opening such that the sealing structure engages the second seal when the valve stem is in the first position. The sealing structure, as well as, the biasing structure is integrally formed with the valve stem. A generally tubular limiter member is positioned about the valve stem and has first and second opposite ends. The first end has a radially extending disc projecting therefrom in engagement with the first seal. The biasing structure engages the second end of the limiter member when the valve stem is in the depressed position. The biasing structure includes a first end interconnected to the valve stem and a second end terminating at a location radially spaced from the valve stem. The terminal end of the biasing structure includes an annular seal formed thereon. The annular seal engages the valve housing. It is contemplated that the biasing structure have a generally bell-shaped configuration.

In accordance with a still further aspect of the present invention, a valve assembly is provided for a container structure holding a composition. The valve assembly includes a valve having an inlet within the container structure and an outlet external of the container structure. The valve is movable between a first position wherein the composition is contained in the container structure and a second position wherein the composition exits the container structure through the outlet of the valve. A generally concave biasing structure extends from the valve stem for urging the valve stem into the first position.

The biasing structure is integrally formed with the valve and includes a first end interconnected to the valve and a second terminal end terminating at a location radially spaced from the valve. A valve housing extends from the container structure about the valve. The terminal end of the biasing structure includes an annular seal formed thereon which engages the valve housing. It is contemplated that the biasing structure have a generally bell-shaped configuration.

In accordance with a still further aspect of the present invention, a mixing valve assembly is provided for a container structure. The container structure has a first chamber for storing a primary composition, a second chamber for storing a secondary composition, and a dispensing member for urging the primary composition from the first chamber and the secondary composition from the second chamber. The mixing valve assembly includes a valve housing extending along a longitudinal axis and defining a first flow chamber. The valve housing includes a first opening in communication with the first chamber, a second opening in communication with the second chamber, and a third opening in communication with the environment external of the container structure. A first seal is disposed in the second opening in the valve housing for isolating the second chamber from the flow chamber. A second seal is disposed in the third opening of the housing for isolating the flow chamber from the environment external of the container structure. A valve stem extends along the longitudinal axis through the first and second seals and has a central passageway therethrough. The valve stem has an inlet, an outlet external of the container structure, and a mixing opening therebetween. The valve stem is movable between a first position wherein the inlet is closed by the first seal and wherein the mixing opening is closed by the second seal and a second depressed position wherein the inlet is in communication with the second chamber and the mixing opening is in communication with the flow chamber. A generally concave biasing structure is integrally formed with the valve stem and urges the valve stem into the first position. The biasing structure includes a terminal end radially spaced from the valve stem for engaging the valve housing. A generally tubular limiter member is positioned about the valve stem and includes a first end having a radially extending disc projecting therefrom in engagement with the first seal and a second end engaging the biasing structure when the valve stem is in the depressed position.

The terminal end of the biasing structure includes an annular seal formed thereon. The annular seal engages the valve housing and the disc of the limiter member. It is contemplated that the biasing structure have a generally bell-shaped configuration.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
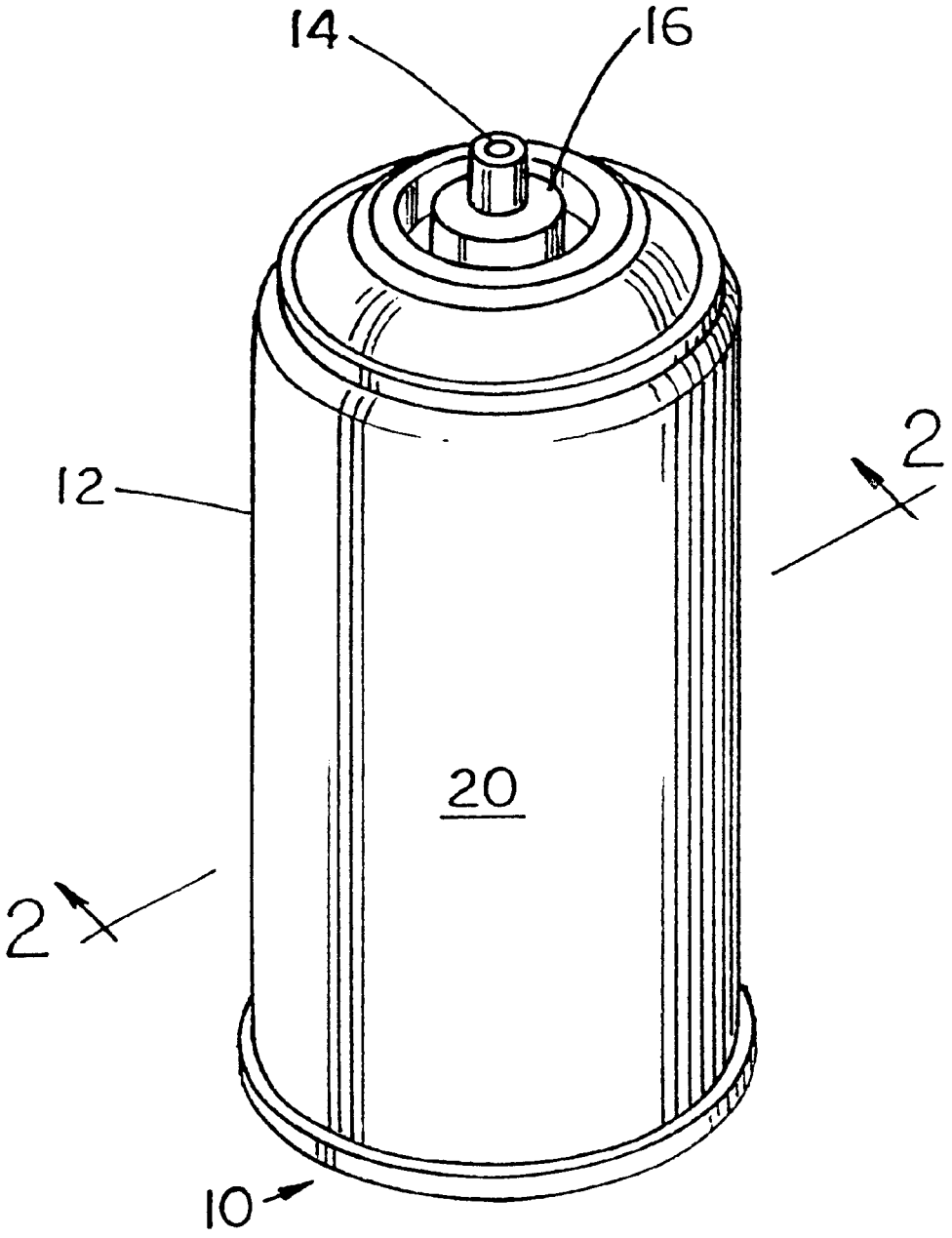
FIG. 1 is an isometric view of a container structure in accordance with the present invention.

Referring to FIG. 1, a container structure in accordance with the present invention is generally designated by the reference numeral 10. As is conventional, container 10 includes an outer shell 12, a nozzle 14 and a valve assembly 16. As hereinafter described, depression of nozzle 14 results in a dispensing of a mixture of a primary and a secondary composition which are stored within container structure 10.

Outer shell 12 of container structure 10 includes a generally tubular side wall 18 having an outer surface 20 and an inner surface 22 defining a first chamber 24 within container structure 10. Side wall 18 includes a first end 26 closed by a bottom wall 28 and an opposite second end 30 having an opening 32 therein for accommodating valve assembly 16. Second end 30 of outer shell 12 includes first and second longitudinally spaced stop surfaces 34 and 36, respectively, for reasons hereinafter described.

A piston 38 is disposed within first chamber 24 in outer shell 12 and divides first chamber 24 into a first portion 40 for receiving the primary composition therein and a second portion 42 for receiving a compressed gas therein. Piston 38 includes a first sealing portion 44 having an outer surface 46 engaging the inner surface 22 of a side wall 18 such that the interface 48 therebetween forms a seal to retain the primary composition within the first portion 40 of first chamber 24 and to retain the compressed gas within the second portion 42 of first chamber 24.

Piston 38 further includes a stopping surface 50 which is longitudinally aligned with stop surface 34 on the second end 30 of outer shell 12 and a second stopping surface 52 which is longitudinally aligned with second stop surface 36 on second end 30 of outer shell 12. Stopping surface 52 includes a depression 54 therein which defines an inner container receiving cavity 56. Depression 54 includes a bottom portion 58 which is complementary to the bottom portion 60 of inner container 62.

Inner container 62 extends along the longitudinal axis of outer shell 12 and is positioned within the first portion 40 of first chamber 24 within outer shell 12. Inner container 62 includes a generally baffled-shaped side wall 64 having an outer surface 66 in communication with first portion 40 of first chamber 24 in outer shell 12 and an inner surface 68 which defines a second chamber 70 within container structure 10. Side wall 64 includes a first end 72 which is closed by bottom portion 60 of inner container 62 and an opposite, second end 74.

A valve housing 76 projects longitudinally from the second end 74 of inner container 62. Valve housing 76 includes a generally cylindrical side wall 78 having a first end 80 integrally formed with second end 74 of inner container 62 and an opposite, second end 82 having a radially extending seal 84 formed thereabout. Inner surface 86 of side wall 78 of valve housing 76 defines a flow chamber 88 therein.

Figure 3:
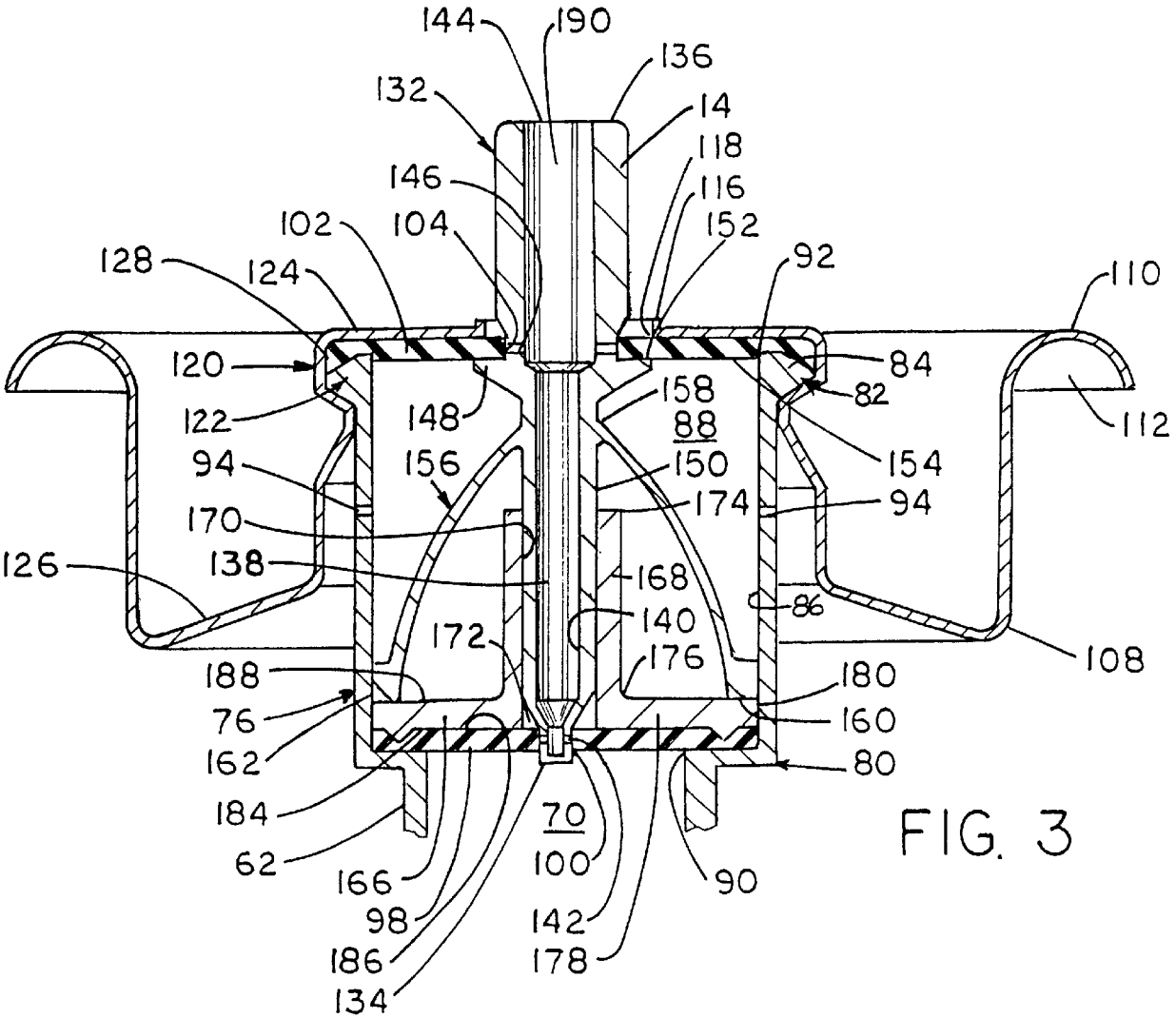
FIG. 3 is an enlarged, cross-sectional view of a valve assembly in a non-actuated position for use in the container structure in the present invention.
Figure 4:
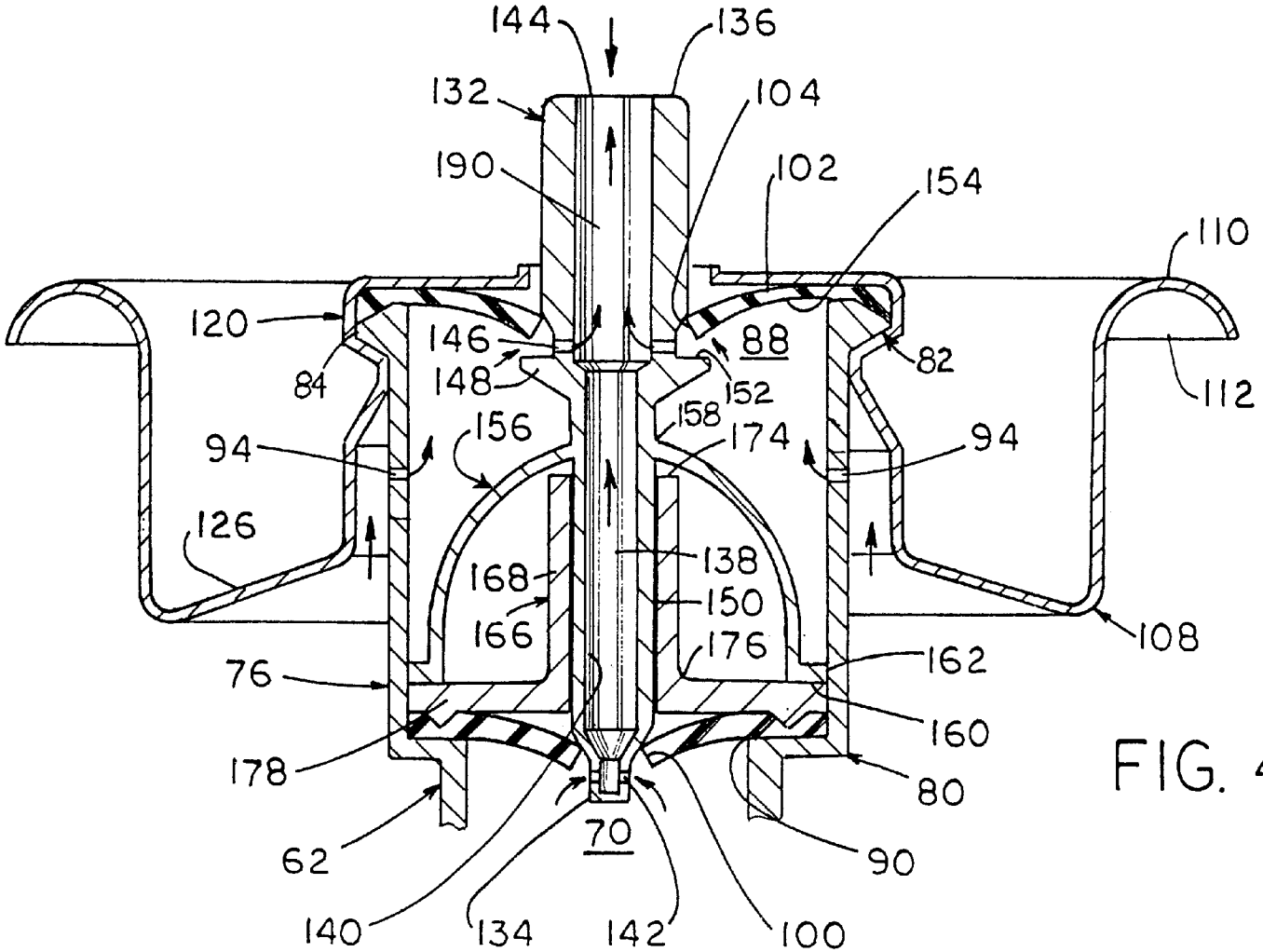
FIG. 4 is an enlarged, cross-sectional view of the valve assembly of FIG. 3 in a actuated position.

Referring to FIGS. 3–4, valve housing 76 further includes a lower opening 90 in first end 80 thereof and an upper opening 92 in second end 82 thereof. A plurality of flow openings 94 are provided in side wall 78 so as to allow first portion 40 of first chamber 24 to communicate with flow chamber 88 within valve housing 76. Lower seal 98 is disposed within valve housing 76 across lower opening 90 therein so as to isolate flow chamber 88 within valve housing 76 from second chamber 70 within inner container 62. Lower seal 98 includes an opening 100 therethrough for reasons hereinafter described. Similarly, an upper seal 102 is positioned over upper opening 92 in order to isolate flow chamber 88 within valve housing 76 from the environment external of container structure 10. Seal 102 includes an opening 104 therein for reasons hereinafter described.

A connection member 108 interconnects valve housing 76 to second end 30 of side wall 18 of outer shell 12. Connection member 108 includes a semi-spherical, radially outer edge 110 which defines a recess 112 therein for receiving terminal edge 114 of second end 30 of outer shell 12. Connection member 108 further includes a radially inner edge 116 defining an opening 118 which overlaps and is in axial alignment with opening 104 in upper seal 102. Connection member 108 further includes a generally C-shaped retaining clip 120 defining a cavity 122 opening radially inwardly towards a longitudinally axis of container structure 10. Retainer clip 120 is interconnected to radially inner edge 116 of connection member 108 by a generally flat plate 124 and is interconnected to radially outer edge 110 of connection member 108 by a generally U-shaped element 126. Cavity 122 in retaining clip 120 is adapted to capture radially outer edge 128 of upper seal 102 and radial seal 84 about second end 82 of valve housing 76 thereby interconnecting valve housing 76 to outer shell 12.

A valve stem 132 extends along the longitudinal axis of outer shell 12 and through opening 118 defined by radially inner edge 116 of connection member 108; opening 104 in upper seal 102; and opening 100 in lower seal 98. Valve stem 132 includes an inlet end 134 disposed within second chamber 70 of inner container 62 and an outlet end 136 disposed externally of container structure 10. Outlet end 136 includes nozzle 14 formed thereon.

A longitudinally extending passageway 138 is defined by inner surface 140 of valve stem 132. An inlet 142 to passageway 138 is provided at the inlet end 134 of valve stem 132 and an outlet 144 of passageway 138 is provided at the outlet end 136 of valve stem 132. A mixing opening 146 to passageway 138 is disposed between the inlet and outlet ends 134 and 136, respectively, of valve stem 132. As best seen in FIG. 3, inlet 142 and mixing opening 146 in valve stem 132 are longitudinally spaced along valve stem 132 such that with valve stem 132 in a non-depressed position, inlet 142 is closed by engagement with lower seal 98 and mixing opening 146 is closed by engagement with upper seal 102.

Valve stem 132 further includes a sealing structure 148 projecting radially from the outer surface 150 thereof at a location adjacent mixing opening 146. Upper surface 152 of sealing structure 148 engages lower surface 154 of upper seal 102 with valve stem 132 in a non-depressed position, FIG. 3, in order to isolate flow chamber 88 from the environment external of container structure 10 and to further maintain closure of mixing opening 146.

A generally concave, bell shaped biasing structure 156 depends from the outer surface 150 of valve stem 132. Biasing structure 156 includes a first radially inner end 158 which is integrally formed with valve stem 132 and a second, opposite terminal end 160 which is radially spaced from outer surface 150 of valve stem 132. A radial seal 162 is formed about terminal end 160 of biasing structure 156 and engages inner surface 86 of side wall 78 of valve housing 76. Biasing structure 156 urges valve stem 132 towards the non-depressed position, FIG. 3.

A generally tubular limiter member 166 includes a first vertical portion 168 having an inner surface 170 defining a passageway 172 for receiving valve stem 132 therethrough. Limiter member 166 includes a first end 174 and a second opposite end 176. A generally flat disc 178 projects radially from second end 176 of limiter member 166 and terminates at a radially outer edge 180 which engages inner surface 86 of sidewall 78 of valve housing 76. Disc 178 includes a lower surface 184 which engages upper surface 186 of lower seal 98 and an upper surface 188 which is engaged by terminal end 160 of biasing structure 156.

Figure 2:
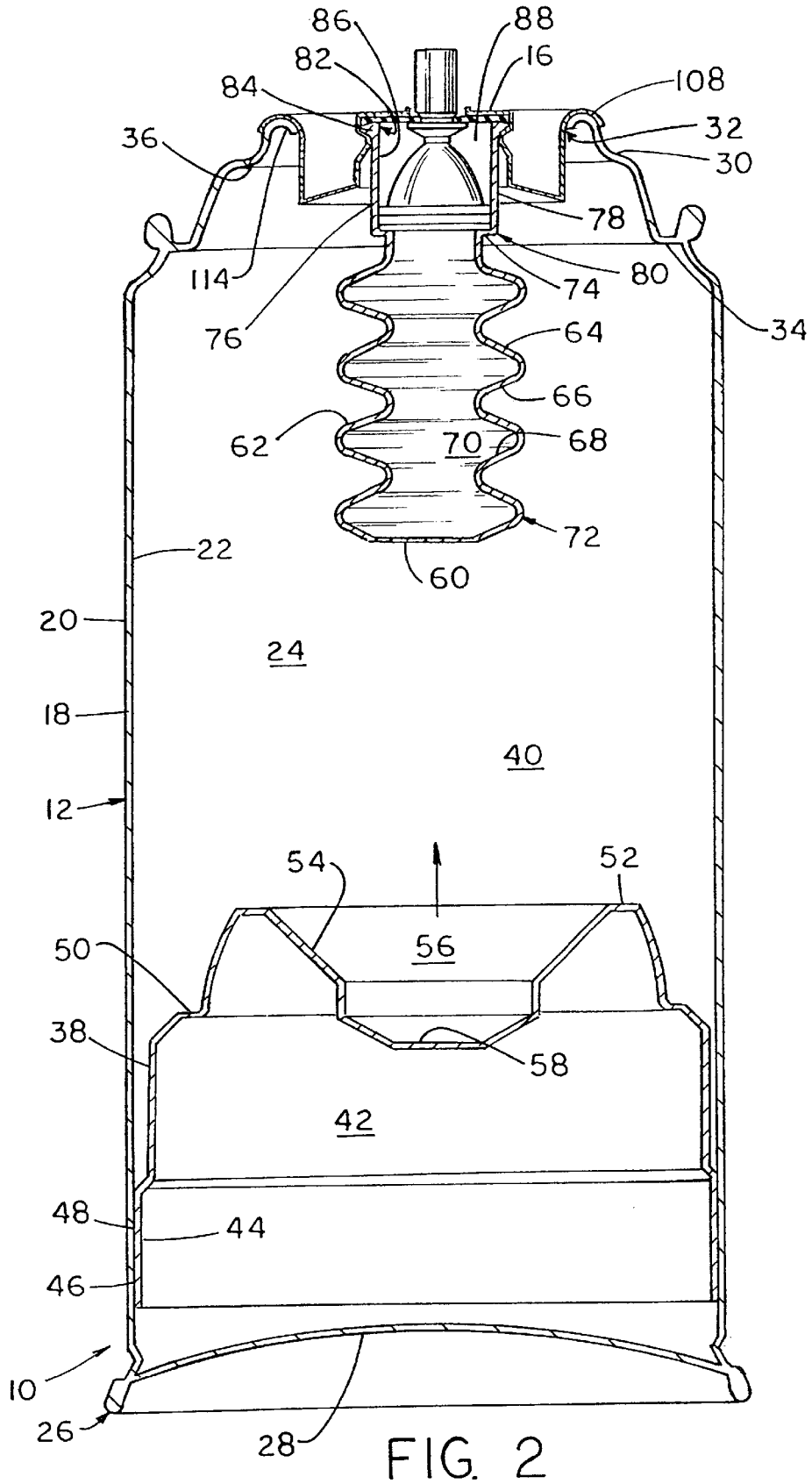
FIG. 2 is a cross-sectional view of the container structure taken along line 2—2 of FIG. 1.

In operation, first portion 40 of first chamber 24 within outer shell 12 is filled with a primary composition and second chamber 70 within inner container 62 is filled with a secondary composition. Compressed gas is disposed within the second portion 42 of first chamber 24 so as to urge piston 38 outwardly in FIG. 2 during the expansion thereof.

Biasing structure 156 urges valve stem 132 towards a non-depressed position, FIG. 3. With valve stem 132 in a non-depressed position, the primary composition enters flow chamber 88 within valve housing 76 through flow openings 94 therein. The primary composition is urged into flow chamber 88 by piston 38 which is urged upwardly by the compressed gas contained in second portion 42 of first chamber 24 of outer shell 12.

As valve stem 132 is depressed, FIG. 4, inlet 142 in inlet end 134 thereof is received within second chamber 70 within inner container 62 such that passageway 138 within valve stem 132 is in communication with second chamber 70 within inner container 62. Similarly, with valve stem 132 in the depressed position, FIG. 4, mixing opening 146 is positioned within flow chamber 88 within valve housing 76 such that passageway 138 within valve stem 132 is in communication with flow chamber 88 within valve housing 76. Valve stem 132 may be depressed against the bias of biasing structure 156 until such point that biasing structure 156 engages first end 174 of limiter member 166. As described, the path of valve stem 132 is limited between the non-depressed position, FIG. 3, wherein sealing structure 148 of valve stem 132 engages the lower surface 154 of upper seal 102 and a depressed position wherein biasing structure 156 engages first end 174 of limiter member 166.

With valve stem 132 in the depressed position, FIG. 4, the compressed gas in second portion 42 of first chamber 24 urges piston 38 upward such that the primary composition in the first portion 40 of first chamber 24 exerts pressure on and begins to collapse inner container 62 thereby urging secondary composition within chamber 70 through inlet 142 in valve stem 132 and into passageway 138. In addition, the primary composition is urged from flow chamber 88 within valve housing 76 into passageway 138 within valve stem 132 through mixing opening 146. The primary and secondary compositions are mixed within a mixing portion 190 of passageway 138 in valve stem 132 and discharged through outlet 144 in nozzle 14. Thereafter, valve stem 132 may be released such that biasing structure 156 urges valve stem 132 to the non-depressed position, FIG. 3. The process may be repeated each time a user wishes to discharge the mixture from container structure 10.

With each subsequent depression of valve stem 132, piston 38 will move upwardly within outer shell 12 of container structure 10 as the compressed gas within second portion 42 of first chamber 24 expands. In addition, inner container 62 will collapse axially on itself due to the presence of the baffles in side wall 64 of inner container 62. Further, the volume of the primary composition in first portion 40 of first chamber 24 and the volume of the second chamber 70 within inner container 62 may be selected such that the mixture dispensed from container structure 10 has a predetermined ratio of second composition to primary composition. The ratio of secondary composition to primary composition dispensed from container structure 10 may also be modified by varying sizes of inlet 142 and mixing opening 146 in valve stem 132.

Various modes of carrying out the invention are contemplated as being within the scope of the following claims particularly pointing out and distinctly claiming the subject matter which is regarded as the invention.

I claim:

1. A mixing valve assembly for a container structure, the container structure having a first chamber for storing a primary composition; a second chamber for storing a secondary composition; and a dispensing member for urging the primary composition from the first chamber and the secondary composition from the second chamber, comprising:

a valve housing extending along a longitudinal axis and defining a flow chamber, the valve housing including a first opening in communication with the first chamber, a second opening in communication with the second chamber, and a third opening communicating with the environment external of the container structure;

a first seal disposed in the second opening in the valve housing for isolating the second chamber from the flow chamber;

a second seal disposed in the third opening in the valve housing for isolating the flow chamber from the environment external of the container structure;

a valve stem extending along the longitudinal axis through the first and second seals and having a central passageway therethrough, the valve stem having an inlet, an outlet external of the container structure, and a mixing opening therebetween, the valve stem movable between a first position wherein the inlet is closed by the first seal and wherein the mixing opening is closed by the second seal and a second depressed position wherein the inlet is in communication with the second chamber and the mixing opening is in communication with the flow chamber; and a generally concave biasing structure formed as a unitary one-piece construction with the valve stem and extending therefrom for urging the valve stem into the first position.

2. The valve assembly of claim 1 further comprising a sealing structure extending radially from the valve stem at a location adjacent to the mixing opening such that the sealing structure engages the second seal when the valve stem is in the first position.

3. The valve assembly of claim 1 wherein the biasing structure has a generally bell-shaped configuration.

4. The valve assembly of claim 1 further comprising a generally tubular limiter member positioned about the valve stem and having first and second opposite ends, the first end having a radially extending disc projecting therefrom in engagement with the first seal.

5. The valve assembly of claim 4 wherein the biasing structure engages the second end of the limiter member when the valve stem is in the depressed position.

6. The valve assembly of claim 1 wherein the biasing structure includes a first end interconnected to the valve stem and a second terminal end terminating a location radially spaced from the valve stem.

7. The valve assembly of claim 6 wherein the terminal end of the biasing structure includes an annular seal formed thereon, the annular seal engaging the valve housing.

8. A mixing valve assembly for a container structure, the container structure having a first chamber for storing a primary composition, a second chamber for storing a secondary composition, and a dispensing member for urging the primary composition from the first chamber and the secondary composition from the second chamber, comprising:

a valve housing extending along a longitudinal axis and defining a flow chamber, the valve housing including a first opening in communication with the first chamber, a second opening in communication with the second chamber, and a third opening communicating with the environment external of the container structure;

a first seal disposed in the second opening in the valve housing for isolating the second chamber from the flow chamber;

a second seal disposed in the third opening in the valve housing for isolating the flow chamber from the environment external of the container structure;

a valve stem extending along the longitudinal axis through the first and second seals and having a central passageway therethrough, the valve stem having an inlet, an outlet external of the container structure, and a mixing opening therebetween, the valve stem movable between a first position wherein the inlet is closed by the first seal and wherein the mixing opening is closed by the second seal and a second depressed position wherein the inlet is in communication with the second chamber and the mixing opening is in communication with the flow chamber;

a generally concave biasing structure integrally formed with and extending from the valve stem for urging the valve stem into the first position, the biasing structure including a terminal end radially spaced from the valve stem for engaging the valve housing; and a generally tubular limiter member positioned about the valve stem and including a first end having a radially extending disc projecting therefrom in engagement with the first seal and a second end engaging the biasing structure when the valve stem is in the depressed position.

9. The valve assembly of claim 8 wherein the terminal end of the biasing structure includes an annular seal formed thereon, the annular seal engaging the valve housing.

10. The valve assembly of claim 8 wherein the terminal end of the biasing structure includes an annular seal formed thereon, the annular seal engaging the disc of the limiter member.

11. The valve assembly of claim 8 wherein the biasing structure has a generally bell-shaped configuration.

12. A mixing valve assembly for a container structure, the container structure having a first chamber for storing a primary composition; a second chamber for storing a secondary composition; and a dispensing member for urging the primary composition from the first chamber and the secondary composition from the second chamber, comprising:

a valve housing extending along a longitudinal axis and defining a flow chamber, the valve housing including a first opening in communication with the first chamber, a second opening in communication with the second chamber, and a third opening communicating with the environment external of the container structure;

a first seal disposed in the second opening in the valve housing for isolating the second chamber from the flow chamber;

a second seal disposed in the third opening in the valve housing for isolating the flow chamber from the environment external of the container structure;

a valve stem extending along the longitudinal axis through the first and second seals and having a central passageway therethrough, the valve stem having an inlet, an outlet external of the container structure, and a mixing opening therebetween, the valve stem movable between a first position wherein the inlet is closed by the first seal and wherein the mixing opening is closed by the second seal and a second depressed position wherein the inlet is in communication with the second chamber and the mixing opening is in communication with the flow chamber;

a generally tubular limiter member positioned about the valve stem and having first and second opposite ends, the first end having a radially extending disc projecting therefrom in engagement with the first seal; and a generally concave biasing structure extending from the valve stem for urging the valve stem into the first position, the biasing structure engaging the second end of the limiter member when the valve stem is in the depressed position.

* * * * *

UNITED STATES PATENT AND TRADEMARK OFFICE

CERTIFICATE OF CORRECTION

PATENT NO. : 6,299,024 B1
DATED : October 9, 2001
INVENTOR(S) : Robert E. Corba

It is certified that error appears in the above-identified patent and that said Letters Patent is hereby corrected as shown below:

Title page,
ABSTRACT,
Line 5, after "first", delete "depressed".
Line 6, after "second", insert -- depressed --.

Signed and Sealed this

Twentieth Day of August, 2002

*Attest:*

*Attesting Officer*

JAMES E. ROGAN
*Director of the United States Patent and Trademark Office*